United States Patent [19]

Royer

[11] 4,196,761

[45] Apr. 8, 1980

[54] SCREW DRIVER WITH RETRACTABLE LEVER ATTACHMENT

[76] Inventor: George R. Royer, 2137 Ragan Woods Dr., Toledo, Ohio 43614

[21] Appl. No.: 11,377

[22] Filed: Feb. 12, 1979

[51] Int. Cl.[2] ..... B25G 1/00; B25G 1/12

[52] U.S. Cl. ..... 145/61 L

[58] Field of Search ..... 145/61 L, 61 G

[56] References Cited

U.S. PATENT DOCUMENTS

| | | | |
|---|---|---|---|
| D. 142,982 | 11/1945 | Bloomfield | 145/61 L |
| 244,309 | 7/1881 | Rhodes | 145/61 L |
| 1,530,905 | 3/1925 | Nance | 145/61 L |
| 1,559,097 | 10/1925 | Hill | 145/61 L |
| 3,863,693 | 2/1975 | Carriker | 145/61 L |
| 4,000,767 | 1/1977 | Geng | 145/61 L |

*Primary Examiner*—Othell M. Simpson
*Assistant Examiner*—J. T. Zatarga

[57] ABSTRACT

A screw driver with a retractable lever member, said lever member being adapted, when moved to its extended position, to yield increased leverage for the user so as to improve the turning movement in the process of either tightening or loosening a screw or other similar object.

1 Claim, 3 Drawing Figures

SCREW DRIVER WITH RETRACTABLE LEVER ATTACHMENT

KNOWN PRIOR ART

U.S. Pat. No. 1,979,460 (Forsberg).

DISCUSSION OF BACKGROUND OF ART

The subject invention applies to screw drivers of all types, whether of the Phillips type or otherwise. Moreover, the invention has general application to all types of tools which are similarly constructed and utilized as the common screw driver. The variations on the common screw driver are manifold, and it would be too cumbersome to delineate all such modifications herein. Therefore, the invention, as stated in the following discussion will be approached generically, with a specific application and preferable embodiment set forth hereinafter.

Screw drivers, and the like, are common tools used frequently in households and work situations. Their relative utility is unquestioned. The ability to use implements and fastening devices in the form of screws is unquestionably far superior to the use of the common nail since the nail is rather difficult to extract once in place.

The common screw driver employs a handle permanently affixed on a shaft bearing the working tool. The handle is conventionally a cylindrically shaped member, the longitudinal central axis of which is concentrically aligned with the longitudinal central axis of the screw driver shaft. This cylindrically shaped handle member usually has a diameter which is larger than the diameter of the screw driver shaft, and generally the diameter may range as much as ten times, more or less, than the shaft diameter.

This relatively larger diameter of the handle, as discussed above, provides a small mechanical leverage to facilitate the turning movement of the particular screw driver. Moreover, the relative ratio of the radius of the handle (R1) to the radius of the shaft (R2, as set forth in FIG. 1 of the drawings, gives a ratio of R1/R2. The formula W=(F) (2R) provides the basic mathematical relationship of leverage forces in screw drivers where W=Work; F—Force applied to the handle; and R=the effective radius of the particular handle. The larger the effective radius, as determined by the ratio R1/R2 the less force is required to be applied to the handle in turning movement to manipulate the particular screw driver.

In some circumstances where a conventional screw driver is utilized so as to loosen a rightly impacted screw, the leverage attained by existing R1/R2 is not sufficient to yield the force to unloosen a screw, given a fixed turning pressure of the hand. In some cases when more force is applied the screw driver shaft strips the screw head causing it to be permanently damaged, and thus much more difficult to extract in such damaged state. If the effective leverage ratio R1/R2 is increased, this would enable the user to extract or implant screws by using less force. This invention is thusly directed to this objective.

OBJECTS

In view of the foregoing it is an object of the subject invention to provide an improved screw driver.

It is also an object of the subject invention to provide a device for improving the leverage of a screw driver;

Yet another object is to provide an improved handle for a screw driver;

Still another object is to provide a device for improving the effectiveness of a screw driver;

Other and further objects of the subject invention will become apparent from a reading of the following description taken in conjunction with the drawings.

DESCRIPTION OF GENERAL EMBODIMENT

The subject invention is a screw driver handle attachment, integrally affixed to a screw driver handle as an auxiliary device to facilitate the turning movements of a screw driver. The attachment is an elongated supplementary handle member which is pivotally mounted to the screw driver at some position along its longitudinal extent. When the handle attachment is unfolded to its fully extended position, the longitudinal central axis of the handle attachment is substantially perpendicular to the longitudinal central axis of the screw driver proper. When the handle attachment is not in use, it is retracted to a position where it can be aligned along the regular handle and fastened thereto. The handle attachment is to be moved to its extended position whenever additional or supplementary leverage is required to extract or tighten a screw.

DESCRIPTION OF PREFERRED EMBODIMENT

The following description is directed to a preferred embodiment of the subject invention, and in this respect, it must be noted that there are other potential embodiments of the subject invention. Therefore, the claims are not to be considered as limited by the following description.

Figure 1:
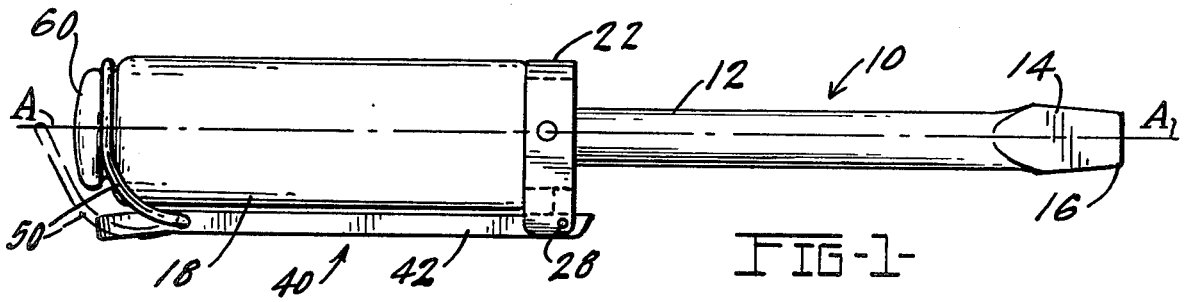
FIG. 1 is a side elevational view of the subject invention showing the subject handle attachment in a retracted position.
Figure 2:
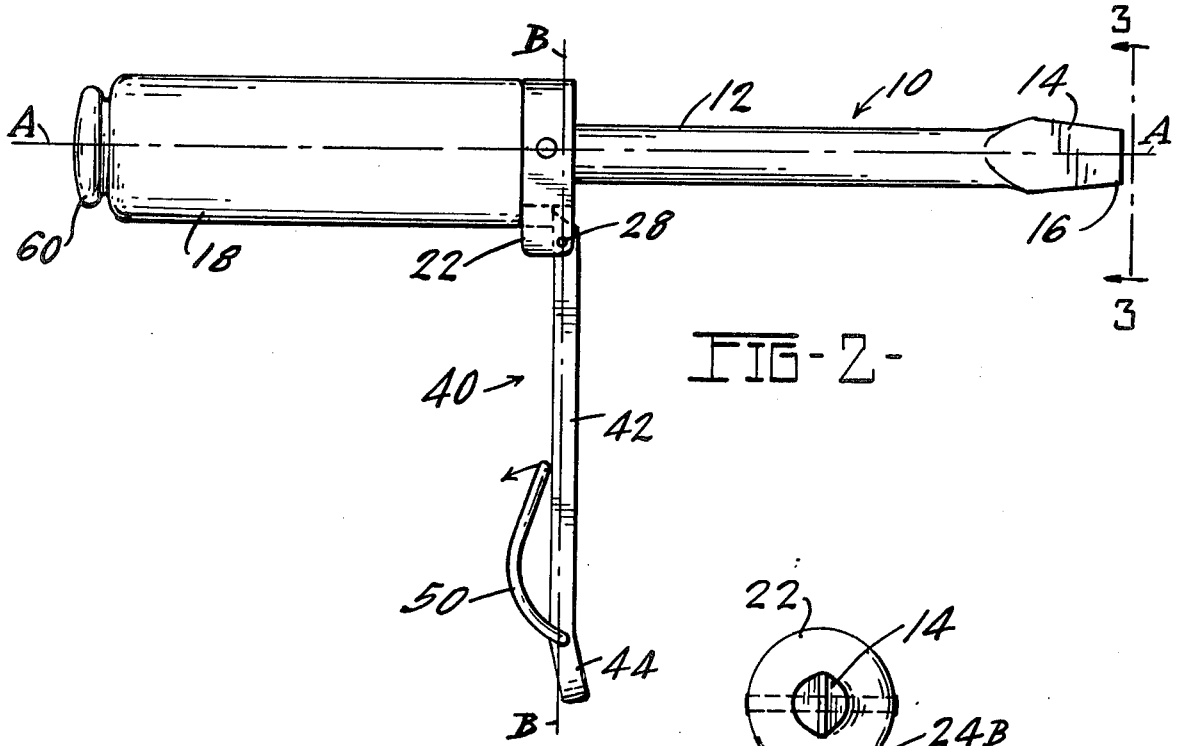
FIG. 2 is a side elevational view of the subject invention showing the subject handle attachment in a fully extended position.

Moreover, in describing the preferred embodiment of this invention, the following definitions and orientation nomenclature shall be used. First, the longitudinal central axis of the screw driver will be designated A—A, as seen in FIG. 1, and this latter axis will represent that imaginery axis which traverses the center of the screw driver member from one end to another in a longitudinal direction. Additionally, the longitudinal axis B—B of the screw driver handle attachment, as represented in FIG. 2, will represent that imaginery axis that extends through the approximate center of said handle attachment from one end to another longitudinally. The word "front" will refer to that end of the screw driver which bears the working tool; while the word "posterior" will refer to that part of the screw driver which is towards the end of the handle and away from the working end.

Referring now to the drawings in which a preferred embodiment is shown, and particularly to FIGS. 1 and 2, a screw driver 10 is shown in longitudinal disposition. Theviews shown in FIGS. 1 and 2 are basically identical as side elevational views, the only variation being in the position of the handle attachment member which is the subject of this invention, and which is more fully described herein below.

Screw driver 10 is generally and basically of conventional construction and disposition, having an elongated, longitudinally extending shaft 12. Shaft 12 is generally of metallic composition, such as hardened steel, and is of substantially cylindrical disposition. The front end 14 of shaft 12 bears the working member 16 which is a flattened portion of the shaft 12. Working member 16 has a linear shaped end which fits into the slot on the head of the screw for purposes of turning the screw.

Integrally mounted on the posterior part of shaft 12 is cylindrical handle member 18. Handle member 18 is preferably affixed on the shaft 12 such that the longitudinal central axis A—A of shaft 12 and cylindrical handle member 18 are coaxially aligned. This latter relationship is clearly indicated in FIGS. 1 and 2, as well as FIG. 3. Usually, in affixing shaft 12 inside handle 18, the shaft is fixedly keyed into the handle 18 such that approximately two-thirds of the shaft is integrally embedded into the interior of handle 18.

Moreover, the handle 18, as obvious from the drawings, is larger in diameter than the shaft 12, and by this larger diametric relationship, the leverage ratio achieved thereby permits more efficient manipulation of the screw driver 10 when one turns it through force applied in a torque movement about handle 18.

The description thus far is that of a conventional screw driver, both in construction and operation. There are, however, many variations to the above-described structure and the exact features described are mainly both exemplary and basic. The features of the invention to be more fully described hereinafter are generally applicable to a screw driver of any specific type or configuration, including a Phillips or or other tools which vary from that basic structure described above.

Referring again to FIGS. 1 and 2, a substantially circular band 22, of metallic construction encircles the frontal area of handle 18. This circular band is rigidly and integrally affixed against axial movement along handle 18, as well as being affixed against a turning, rotational movement around the girth of handle 18. In short, the band 22 is rigidly affixed against any type of movement relative to handle 18.

Figure 3:
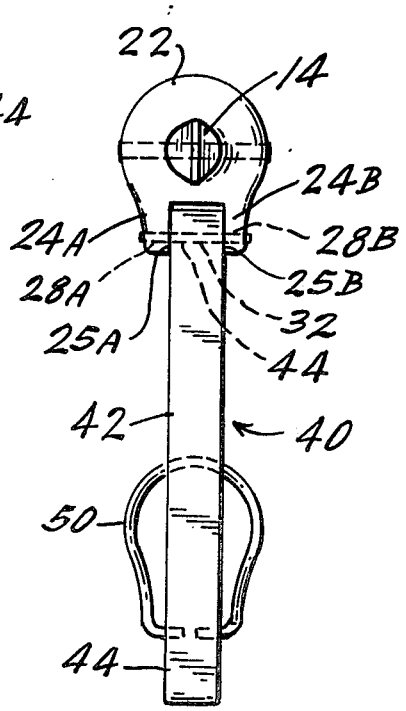
FIG. 3 is an end elevational view of the subject invention, showing the subject handle attachment in a fully extended position.

Referring to FIG. 3, disposed on the one side of band 22 are a pair of tangentially disposed lobe members 24A and 24B; said lobe members being an integral part of such band 22. More particularly, when viewed on end, from the posterior end of the screw driver 10, as seen in FIG. 3, the two lobe members 24A and 24B are located on the bottom area of band 22, and in this view shows that the lobes 24A and 24B are mutually parallel with the respective interior opposing walls, represented as 25A and 25B, being machined to flat mutually parallel surfaces.

Machined in linear fashion through each lobe 24A and 24B are transversely extending bores 28A and 28B respectively, both of cylindrical dispostion. These latter bores 28A and 28B respectively, both are of cylindrical disposition. These latter bores 28A and 28B serve to house a cylindrically and conformingly shaped pin 32, such that pin 32 is freely rotatable in said bores 28A and 28B.

The handle extension member 40 which is the main element of this invention mainly comprises a longitudinally extending arm member 42. As viewed in FIG. 3, the upper part of arm 42 has a transversely extending bore 44 which is adapted to receive pin 32. With pin 32 inserted in bore 44 and thence through bores 28A and 28B, and then appropriately locked, the handle 42 is thusly affixed in a pivotal manner to the band 22. As a consequence of this latter relationship, the handle 42 is fixedly but pivotally mounted to screw driver handle 18, such that the handle can be pivoted from a position aligned along the handle 18, as shown in FIG. 1, to a position perpendicular to the axis A—A of screw driver 10, as shown in FIG. 2. Thus, when the handle 42 is in the retracted position it lies unobtrusively in parallel along the handle 18. When it is extended, it lies perpendicular to axis A—A for potential auxiliary use, as described herein below.

As pivotally connected to the frontal part of handle 18, the arm 42 is pivotal and moveable relative to screw driver 10 and it is capable of movement through an area of approximately ninety degrees from the retracted (parallel) position to extended position, as seen in FIGS. 1 and 2. When the arm 42 is extended to the substantially perpendicular position shown in FIG. 2, the user can grasp the arm 42 at or near end 44 thereof and when turning the screw driver 10 clockwise or counterclockwise, he can use his or her other hand to rotate the arm 42 about axis A—A in the same clockwise or counterclockwise movement. With the additional leverage achieved by using the arm as an auxiliary aid, the screw driver 10 can be turned with less force.

When the extra leverage of arm 42 is not needed, arm 42 can be retracted to the storage position shown in FIG. 1. In this latter position, the arm 40 will be flush against the handle 18 in a lengthwise, parallel alignment. For purposes of holding the arm against handle 18, a spring clip snap-on loop 50 is pivotally mounted to the end of arm 40, and this is designed to snap on spring clip holding knob 60 located on the posterior end of handle 18. More specifically, said spring clip holder knob 60 integrally formed on the posterior end of handle 18 and particularly comprises an annular depression encircling the handle on the frontal end of such knob 60. The knob extension 60 has a diameter larger than the annular depression and its diameter is just slightly smaller than the loop.

More specifically, the holding structure is a spring clip holding knob 60 which is coaxially affixed at the posterior end of the handle member on the screw driver. This knob extension 60 on its frontal end, has on the end disposed towards the screw driver shaft an annular depression around the periphery thereof, as clearly shown in FIGS. 1 and 2. The knob 60 and the annular depression each have a diameter which is smaller than the spring clip loop, so that the pivotally mounted loop can be moved over the posterior portion of the knob extension and into engagement in the annular depression as shown in FIG. 2. For this purpose it is advantageous to have the knob extension just slightly smaller than the loop.

While the foregoing description is of a preferred embodiment, it is to be understood that the scope of the following claim is not to be limited by such specific description.

I claim:

1. An auxiliary handle attachment for a screw driver with a working shaft on the front end of said screw driver and a handle member of the posterior end of said screw driver, and wherein said handle member and working shaft are coaxially aligned, said auxiliary handle attachment comprising:

(a) a longitudinally extending arm member one end of which is pivotally mounted to said handle member on said screw driver;

(b) pivot means on the handle member of said screw driver to allow said arm member to move to a position wherein said arm member is perpendicular to the working shaft of said screw driver and back to a position aligned along said handle member;

(c) knob extension means integrally affixed on the most rearward extreme of said handle member with the frontal portion of said knob extension having an annular depression extending around the periphery of the frontal portion of said knob extension;

(d) spring clip loop means pivotally mounted on the end of the longitudinally extending arm, which end is axially opposite the end on which said pivot means is affixed, said spring clip loop means having an inner diameter which is larger than the diameter of the said knob extension;

(e) pivot means on said longitudinally extending arm member to allow pivotable movememt of said loop means into engagement over said knob extension and onto said annular depression.

* * * * *